US005768858A

United States Patent [19]

Hannen

[11] Patent Number: 5,768,858

[45] Date of Patent: Jun. 23, 1998

[54] METHOD AND APPARATUS FOR PACKAGING A ROLL OF MATERIAL

[75] Inventor: Jakob Hannen, Willich, Germany

[73] Assignee: Voith Sulzer Finishing GmbH, Krefeld, Germany

[21] Appl. No.: 714,769

[22] Filed: Sep. 16, 1996

[30] Foreign Application Priority Data

Sep. 26, 1995 [DE] Germany ..... 195 35 746.9

[51] Int. Cl.[6] ..... B65R 11/04

[52] U.S. Cl. ..... 53/465; 53/211; 53/214

[58] Field of Search ..... 53/465, 211, 214, 53/215, 372.9

[56] References Cited

U.S. PATENT DOCUMENTS

| | | | |
|---|---|---|---|
| 2,844,928 | 7/1958 | Clem | 53/198 |
| 2,880,560 | 4/1959 | Gibson | 53/211 X |
| 2,893,191 | 7/1959 | Lancaster | 53/214 X |
| 4,341,586 | 7/1982 | Koutonen | 53/211 X |
| 4,534,151 | 8/1985 | Schneck et al. | 53/211 X |

FOREIGN PATENT DOCUMENTS

| | | |
|---|---|---|
| 0 004 471 | 10/1979 | European Pat. Off. . |
| 0 499 954 | 8/1992 | European Pat. Off. . |
| 0 519 672 | 12/1992 | European Pat. Off. . |
| 2.229.614 | 12/1974 | France . |
| 1 009 556 | 5/1957 | Germany . |
| 750561 | 6/1956 | United Kingdom . |
| 1 429 445 | 3/1976 | United Kingdom . |

*Primary Examiner*—Linda Johnson
*Attorney, Agent, or Firm*—Darby & Darby

[57] ABSTRACT

An apparatus and method for packaging a roll of web material with a packaging material includes a wrapping station that has a roller drive. A packaging strip dispenser has a packaging material delivery device. A position of the packaging strip delivery device is adjustable so that an acute angle is defined between a longitudinal axis of the packaging material being dispensed by the packaging material delivery device and a circumferential direction of the roll of web material. The circumferential direction is a direction that is tangent to a circumferential surface of the roll and is parallel to an axial end of the roll. The packaging material is axially movable with respect to the roll of web material. A first strip of the packaging material is placed against the roll so that a longitudinal axis of the first strip of packaging material is disposed at an acute angle with respect to the circumferential direction of the roll of web material. The first strip of packaging material is helically wrapped around the roll of web material.

15 Claims, 2 Drawing Sheets

METHOD AND APPARATUS FOR PACKAGING A ROLL OF MATERIAL

BACKGROUND OF THE INVENTION

1. Field of the Invention

The present invention relates to a method and apparatus for packaging a roll of web material by wrapping the circumference of the roll of web material with a packaging material. The apparatus includes a wrapping station that has a pair of rollers, of which at least one roller is rotatably driven. The apparatus further includes a packaging material dispenser that has a packaging material delivery device.

2. Discussion of the Related Art

Rolls of web material (hereinafter sometimes referred to as a roll(s)) typically have a diameter of 500 to 2,100 mm. The width (i.e., axial length) of the rolls is typically from 500 to 3,800 mm, and, on occasion, is even wider. These rolls of web material are created, for example, in the paper and textile industries. To transport the rolls from their production site, such as, for example, a paper factory, to the consumption site, such as, for example, a printing plant, the rolls must be covered with a packaging material to protect the roll from being damaged during shipment. The packaging material protects the rolls from mechanical damage and from damage that can be caused by the environment, such as, for example, humidity.

European reference EP 0 499 954 A1 discloses a great number of packaging material rolls, each of which has a different width to accommodate various rolls that may have different widths. The rolls are divided into various classes depending on their width. A packaging material roll, which has a predetermined width, is assigned to each roll width class. The packaging material must be wide enough that it axially projects beyond the axial ends of the roll by a minimum length, which is usually about 100 to 250 mm. The projection must be large enough that it can be folded in on the axial end of the roll. But the projection should not be too long because, if it is, the folding in of the projection will no longer take place with the desired quality. The folding in of the projection is especially important, for example, when the finished packaged rolls are stacked axially one on top of one another. This type of stacking is known in the art as vertical stacking.

Conventionally, many packaging rolls must be kept available for the many different widths of the rolls of web material. Of course, stocking a great number of packaging material rolls is a considerable logistic expense. In addition, a relatively large amount of storage space must be made available in the packaging material dispenser for the many packaging rolls. Thus, using many packaging rolls takes up space, increases the maintenance expenses and increases the expense that is required to build the packaging machine.

SUMMARY OF THE INVENTION

It is an object of the present invention to simplify the packaging of a roll of web material.

This object is achieved by placing a first strip of packaging material against the roll so that a longitudinal axis of the first strip of packaging material is disposed at an acute angle with respect to the circumferential direction of the roll of web material. The circumferential direction of the roll is a direction that is tangent to the circumferential surface of the roll and extends parallel to the axial ends of the roll. Thus, the circumferential direction is perpendicular to the longitudinal axis of the roll. The first strip of packaging material is then helically wrapped around the roll. Thus, a packaging material roll having a single width is all that is required to package all rolls of web material, regardless of their width.

The helical wrapping of a packaging material about a roll, per se, is known, for example, from European Reference EO 0519 672 A1. The European '672 reference requires that the packaging material be moldable; the packaging material's longitudinal edge is first placed on the roll so that that edge is perpendicular with respect to the circumferential direction of the roll. In other words, the longitudinal edge of the packaging material is parallel to the axis of the roll and a longitudinal axis of the packaging material is disposed parallel with respect to the circumferential direction of the roll. After a lower portion of the roll is enclosed with packaging material, a support arm is raised, causing the moldable packaging material to helically wrap around the roll.

In accordance with the present invention, a position of the packaging material is preferably adjustable so that adjacent wrapping layers of the packaging material overlap one another. Thus, an entirely connected sheath about the circumference of the roll of web material is achieved with a single wrapping action.

Adjacent wrapping layers overlap each other by approximately half the width of the packaging material. Thus, except for the end layers, adjacent wrapping layers of the packaging material contact one another, which results in a double layer sheath about the roll. A double layer sheath is usually sufficient to protect the roll of web material. The covering is large enough to prevent the penetration of moisture or other environmental influences through the gap between successive layers of the packaging material. Because the sheath is wrapped helically, it can be completed with a single wrapping action. A thicker sheath disposed about the circumference of the roll (i.e., a sheath that is made up of more than two layers of packaging material) is often undesirable for cost reasons.

The helically wrapped packaging material is disposed between the axial ends of the roll. Thus, a non-uniform projection of the packaging material beyond the axial ends of the roll is avoided. If a non-uniform projection is folded in on the axial end of the roll, the thickness of the fold will not be uniform. If the packaged roll was then vertically stacked, a skewed position of the individual rolls may result. Thus, it is preferable to avoid a situation where this type of lack of uniformity in the fold can result.

A second strip of packaging material is placed against the roll so that a longitudinal axis of the second strip is disposed parallel to the circumferential direction of the roll. The second strip is then wrapped about the roll to form an axial projection in the area adjacent to an axial end of the roll. This second strip of packaging material thus forms an edge strip, which, in contrast to the first strip packaging material, no longer extends at an angle with respect to the circumferential direction, but is parallel to it. This operation is repeated with a third packaging strip at the other axial end.

The edge strip covers the area at the axial end of the roll that is left exposed during the initial and final wrapping of the roll of web material. As a result, the circumference of the roll of web material is protected in the area of the edges of the roll. Simultaneously, the edge strip forms a projection that can later be folded in on the axial face of the roll so that it may be fastened, in a conventional manner, between an inside front cover and an outside front cover. Thus, the finished, packaged roll according to the present invention, is substantially identical to a conventionally packaged roll as far as the axial end is concerned.

Preferably, all three strips of packaging material originate from the same width of stock packaging material. Consequently, only a single width of stock is required, which considerably simplifies logistics and storage concerns. A single roll may be used for all packaging strips. Additionally, the roll packaging device according to the present invention is lighter than conventional devices and is simpler to design.

The second and third strips of packaging material are preferably applied after the first strip of packaging material. The first strip of packaging material is connected to the outermost layer of web material. The second strip of packaging material is connected to the first strip of packaging material, which has been applied previously. Thus, the first strip of packaging material can be connected practically over the entire outermost layer of the web of material, which increases the reliability of the packaging. Additionally, by attaching a second packaging strip at one axial end and a third packaging strip at the other axial end, the axial edges of the roll become somewhat thicker (i.e., they attain a slightly larger diameter), which makes the subsequent transport of the rolls easier, particularly via rolling.

The second and third strips of packaging material are wrapped around the roll with a greater number of layers than the first strip of packaging material. Thus, the sheath that is formed by the first strip of packaging material is formed as cost-effectively as possible because it is formed from as few layers of packaging material as possible. Additionally, there is a need in the art to protect the edge of the rolls as well as possible. In accordance with the present invention, the edges of the rolls can be wrapped with multiple layers (i.e., more than two layers) thereby providing extra protection for the edges of the roll.

The present invention permits both of these requirements to be met. The roll is sheathed, for example, with two layers of the packaging material over the greatest part of its axial length, while four to six layers are typically applied on the edges to protect the edges of the roll.

Adjacent packaging material sections are preferably glued to one another. Thus, the overall package acts as one cohesive unit. The package is stable and protects the roll of web material from outside influences, such as, for example, being penetrated by moisture. The gluing process can take place by applying an adhesive. But a packaging material that already has an adhesive applied thereto can also be used. The adhesive can be made adherent, for example, by wetting a gummed surface or heating a PE layer or in other manners that are known by those skilled in the art.

The packaging material is preferably a packing paper. Packing paper has proven to be effective in packaging rolls of web material. But packing paper has a risk of tearing if it is subjected to a non-uniform stress. For this reason, until now, packing paper could only be used if the circumference of the roll was sheathed uniformly. According to the present invention, packing paper can now be used even if the width of the packing paper web is considerably narrower than the width of the roll that is to be packaged.

The packaging material preferably has a width of at least 350 mm. This minimum width provides the desired axial projection of 100 to 150 mm for the second and third packaging strips at the axial ends of the roll. Additionally, this minimum width enables the packaging material to be wound around the roll in such a manner as to achieve the desired cohesion (i.e., the overlapping between adjacent wrapping layers of packaging material is sufficient to protect the packaged roll from being damaged by external elements). In a preferred embodiment, the packaging material has a width of approximately 500 mm.

An apparatus for packaging a roll of web material according to the present invention includes a packaging material delivery device that is adjustable so that an acute angle is defined between a longitudinal axis of a packaging material being dispensed by the packaging material delivery device and a circumferential direction of the roll of web material. The packaging strip dispenser is axially moveable with respect to the roll of web material.

The packaging material delivery device is a part of the packaging strip dispenser and is disposed adjacent to where the packaging material exits from the dispenser. If the packaging material delivery device is disposed at an acute angle with respect to the circumferential direction of the roll of web material, the longitudinal edge of the packaging material defines an acute angle with respect to the circumferential direction of the roll. Additionally, an acute angle is defined between the longitudinal axis of the initially dispensed packaging material and the circumferential direction of the roll. Hence, if the roll is rotated, a helical wrapping of the packaging material about the roll automatically occurs. Because the packaging strip dispenser is moved axially at the same time, no impermissible lateral stress is created in the packaging material, which, particularly for packing paper, prevents tearing of the packaging material.

The packaging material is preferably dispensed from a packaging roll, which has an axis. The packaging roll is moveable (e.g., rotatable) from a position in which its axis is parallel to the axis of the roll into a position in which the axes define an acute angle. Therefore, no complicated reversing devices are required to reverse the packaging material. On the contrary, in accordance with the present invention, the packaging material can be pulled linearly from the packaging material roll and placed directly on the circumferential surface of the roll of web material. The packaging material roll can be rotated into a position with respect to the roll of web material in which both axes are parallel so that edge strips can be formed from the same packaging material roll. These edge strips form the axial projections and protect the edges of the roll.

The entire packaging strip dispenser is rotatable with respect to the roll of web material. Thus, the packaging strip dispenser is one unit that is essentially built in the same manner that conventional packaging material dispensers are. But, in contrast to conventional apparatuses, the packaging strip dispenser according to the present invention only needs to be able to rotate. This can easily be achieved, for example, by rotatably mounting the packaging material dispenser on a slide. The slide effects the axial movement of the dispenser with respect to the roll.

The packaging strip dispenser includes a driving gear to move the packaging strip dispenser axially with respect to the roll of web material. By using a driving gear to axially move the dispenser, the load on the packaging material is kept at minimum. In other words, in accordance with the present invention, the axial movement no longer creates lateral forces on the packaging material.

A control device is preferably connected to a diameter measuring device to measure the diameter of the roll of web material. The control device controls and coordinates the wrapping speed of the roll and the forward axial feed rate of the packaging strip dispenser based on the diameter of the roll of web material. Thus, a wrapping of the roll can be achieved that is essentially stress-free (i.e., no lateral stresses are created in the packaging material). If the diameter of the roll that is to be packaged and the angle of the longitudinal axis of the packaging material (i.e., the initial feed direction of the packaging material) with respect to the circumferential direction of the roll are known, then the axial speed that the packaging strip dispenser must be moved with respect to the roll can easily be determined by the control device and the rate of rotation of the driving gear can consequently be controlled.

The packaging strip dispenser preferably includes an adhesive application device to permit adhesive to be applied directly to the packaging material after it is unwrapped from the packaging material roll. If a packaging material that is already coated with adhesive is being used, the adhesive application device can be replaced with an adhesive activating device. The adhesive activating device can be, for example, a water applicator that applies water to the packaging material. For packaging materials that are PE-coated, a heat applicator may be used to activate the adhesion of the packaging material.

DETAILED DESCRIPTION OF A PREFERRED EMBODIMENT

Figure 1:
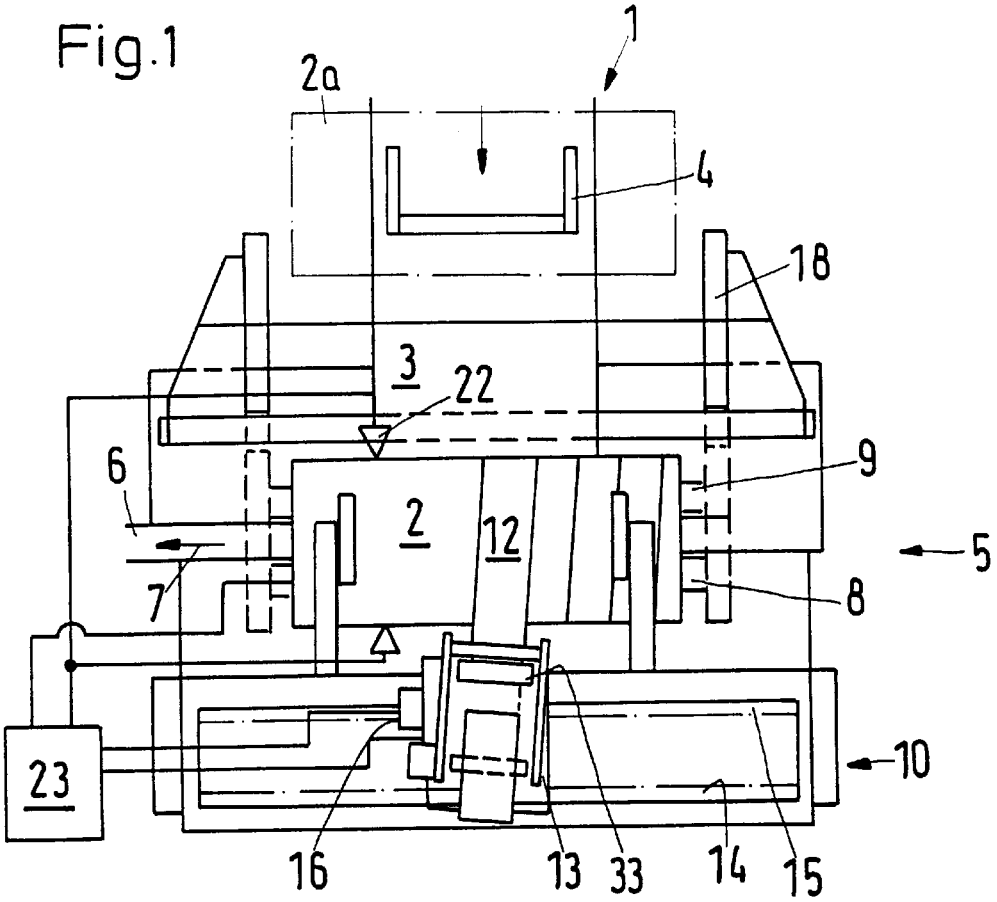
FIG. 1 is a schematic top view of a device for packaging a roll of web material according to the present invention.
Figure 2:
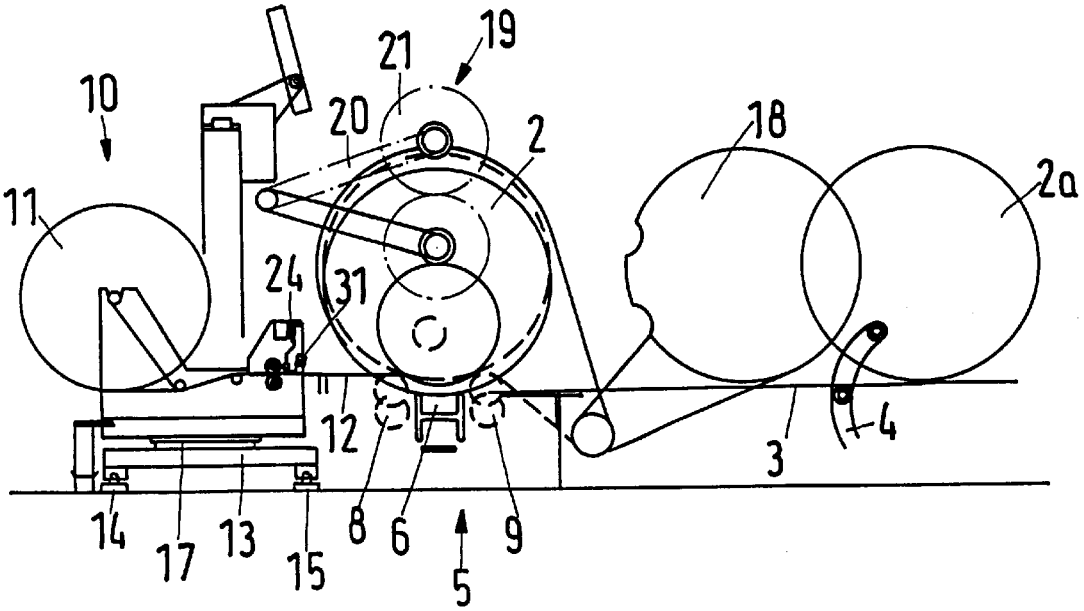
FIG. 2 is a side view of the device illustrated in FIG. 1.

Referring now to FIGS. 1–2, a roll packaging device 1 is illustrated. Device 1 packages a roll 2 of web material. Rolls typically have a diameter in the range of from 500 to 2,100 mm and a roll width (i.e., an axial length) of from 500 to 3,800 mm; sometimes the width is even greater. Device 1 also includes a roll conveyer 3 and a roll catching device 4. An incoming material web roll 2*a* is stopped by the roll catching device 4 and, at the appropriate time, is permitted to roll into wrapping station 5. Roll 2 is then deposited on a conveyer belt 6, which advances the roll for further processing, in the direction indicated by arrow 7 in FIG. 1, after it has been packaged.

Two rollers 8, 9 are attached laterally next to the conveyor belt 6. Roller 8 is preferably rotatably driven. Both rollers 8, 9 are movable in the vertical direction to lift the roll off of belt 6 to permit roll 2 to rotate.

Device 1 further includes a packaging strip dispenser 10. Dispenser 10 stores a roll 11 of packaging material 12. The packaging material 12 is delivered to the wrapping station 5 by a delivery device 33. The packaging strip dispenser 10 is disposed on a slide 13. Slide 13 can be moved on rails 14, 15, by driving gear 16, in a direction that is parallel to the longitudinal axis of roll 2.

Packaging strip dispenser 10 is pivotable with respect to slide 13. Dispenser 10 has a rotatable driving gear 17, which, when actuated, changes the angle between the axis of roll 11 and the axis of roll 2. Rotatable driving gear 17 can align the packaging web dispenser 10 so that both the axes of roll 2 and roll 11 are parallel to one another or they can define an acute angle therebetween (as illustrated in FIG. 1). When the axes define an acute angle, the same acute angle is defined between the longitudinal axis (i.e., the direction of extension) of the packaging material 12 and the circumferential direction of roll 2. The circumferential direction of roll 2 is defined to be a direction tangent to the circumferential surface of roll 2 that extends parallel to the axial ends of the roll.

Device 1 further includes a pivoting packing press 18 disposed on each side (i.e., at each axial end) of the roll 2. A folding apparatus 19 is also disposed on each side of roll 2. Folding apparatus 19 includes a folding wheel 21 that is attached to a lever 20.

Device 1 also includes a thickness gauging device 22 to measure the diameter of roll 2. Thickness gauge 22 is connected to a control device 23. Control device 23 is also connected to the driving gear 16 for the slide 13 of the packaging web dispenser 10, to the driving gear (not shown) of the driven roller 8 and to the rotatable driving gear 17 that adjusts the angle between the packaging dispenser 10 and the slide 13.

Figure 3:
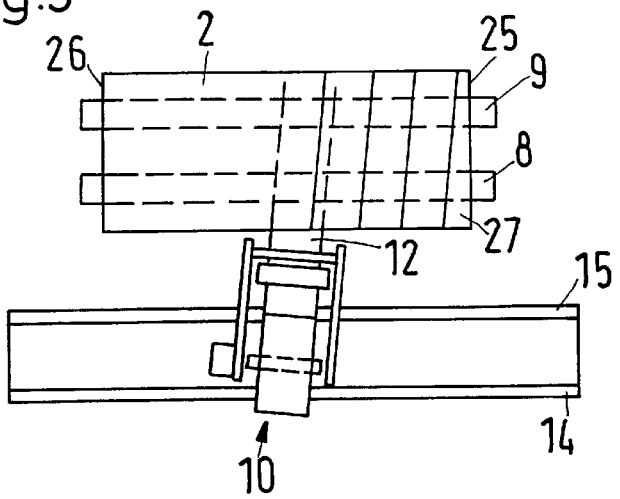
FIGS. 3–5 are partial schematic top views, at various stages, of the device as it packages a roll.

The operation of roll packaging device 1 will now be described. Slide 13 is first moved to an area adjacent to axial end 25 of the roll 2. Slide 13 is placed diagonally with respect to roll 2 (i.e., the axis of roll 11 and the axis of roll 2, which is to be packaged define an acute angle with respect to one another) (See FIG. 3). Packaging material 12 is dispensed from roll 11. Glue or another adhesive is placed on an upper surface of the packaging material 12 with the aid of an adhesive application station 24. The packaging material 12 is then guided into contact with the outer circumferential surface of the roll of web material 2 in such a way that essentially no portion of the packaging material 12 projects beyond the axial end of roll 2. Thus, the initial wrapping of roll 2 by packaging material 12 leaves an uncovered section 27 of roll 2. Uncovered section 27 is essentially wedge or triangular shaped.

Driven roller 8 is rotated under the control of control device 23 to cause roll 2 to rotate. But before roller 8 is rotated, control device 23 causes packaging material dispenser 10 to rotate so that the angle between the packaging material roll 11 axis and the axis of the roll of web material 2 is adjusted so as to produce a helical wrapping of the packaging material 12 about roll 2. Once roller 8 begins rotating, driving gear 16 is actuated, under the control of device 23, to cause the packaging material dispenser 10 to move axially with respect to roll 10.

The wrapping takes place so that successive layers of packaging material 12 overlap the immediately preceding layer by approximately half the packaging material width. Thus, as a result, a double layer sheath of packaging material is created that consists of two layers or plies of packaging material over practically the entire axial length of the roll 2 of web material. The packaging material is thus wrapped about roll 2 so that one half of its longitudinal length is exposed to the outside and the other half is covered by the immediately adjacent overlapping winding of packaging material 12. Adhesive can be continuously applied to the packaging material 12 so that one half of the packaging material 12 will adhere to the circumference of roll 2 and the other half will adhere to the immediately adjacent overlapping winding of packaging material. In a preferred embodiment, the adhesive applicator station 24 is an adhesive grader.

Figure 4:
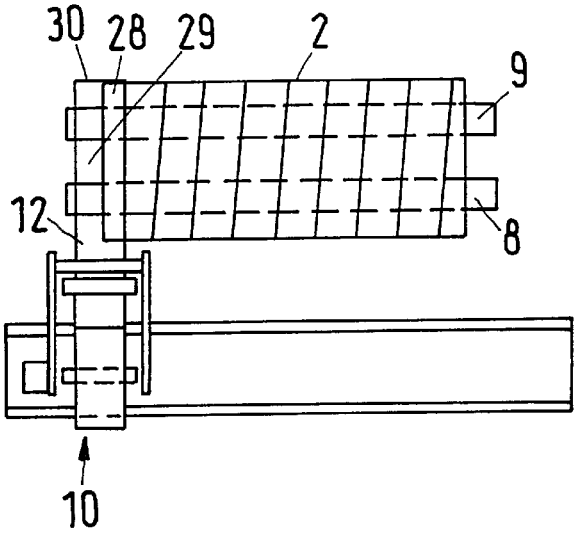

The packaging material 12 is initially wrapped in a helical manner onto roll 2 in such a manner that it does not project beyond the axial end 25 of roll 2. Similarly, the helical wrapping of roll 2 is stopped at the second axial end 26 of roll 2 so that the packaging material 12 does not project beyond the second axial end 26 of roll 2. Thus, uncovered sections 27, 28, which are essentially wedge or triangular-shaped remain at the ends of the roll. When the material web roll 2, with the exception of the uncovered sections 27, 28, is completely covered by the packaging material 12, the packaging material 12 being dispensed from roll 11 is cut with the aid of a cutting blade 31. The packaging strip dispenser 10 is located in approximately the position illustrated in FIG. 4 adjacent to the second axial end 26 of roll 2. In this position, dispenser 10 is rotated so that it will guide the dispensing packaging material 12 at a 90° angle with respect to the longitudinal axis of roll 2. Simultaneously, dispenser 10 is axially positioned so that the packaging web 12 forms an axial projection 29 with respect to roll 2. Axial projection 29 preferably has an axial length of approximately 100 to 150 mm. An adhesive is applied to this second strip of packaging material 12 by application station 24 so that the individual layers of packaging material 12 adhere permanently to one another. The packaging material 12 that is wrapped in the circumferential direction around the material web roll 2 forms an edge strip 30, which later can be folded in, with its projection 29, on the second axial end 26 of roll 2. Edge strip 30 protects the edges of roll 2. Generally, a stronger sheath is required to protect the edges of the roll than the circumferential surface of the roll. Thus, the edge strip 30 is formed with a greater number of layers of the packaging material 12 than the rest of the sheath.

Once the desired number of layers have been dispensed from roll 11 to form the edge strip 30, the cutting blade 31 is actuated to cut the second strip of packaging material 12. Roll 2 continues to rotate until the just cut piece of packaging material completely wraps around the roll.

Figure 5:
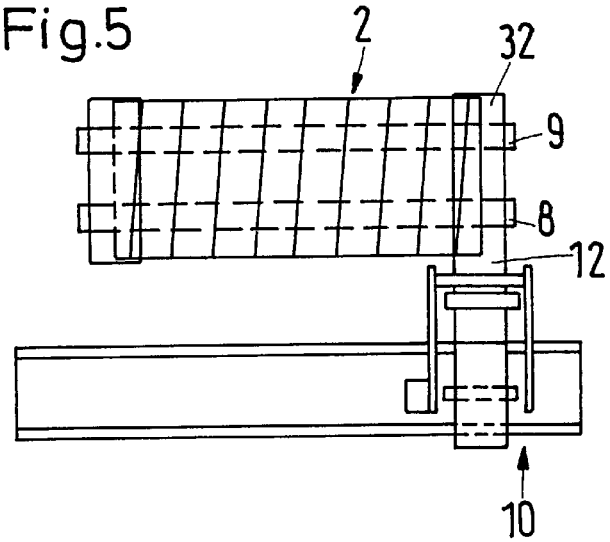

Packaging dispenser 10 then moves to the first axial end 25 of roll 2, as shown in FIG. 5. Dispenser 10 dispenses a third strip of packaging material 12 to form an edge strip 32 on the first axial end 25 of roll 2 in a manner that is similar to how edge strip 30 is applied on the second axial end 26 of roll 2. Thus, edge strip 32 projects beyond the first axial end 25 of roll 2 and is comprised of several layers of packaging material 12.

After or while the edge strips 30, 32 are being formed, convention front covers (not shown) are inserted into the packaging web projections 29 adjacent to the axial ends 25, 26 of the roll in a known manner. Folding device 19 is used to fold the projections 29 in onto the inside front covers. Conventional outside front covers (not shown) are then placed on the axial ends of the packaged roll with the aid of packing presses 18. Outside front covers adhere to the folded-in projections 29.

Rollers 8, 9 are lowered so that the now packaged roll 2 is placed on conveyor belt 6. The packaged material roll 2 is then removed from wrapping station 5 with the aid of conveyor belt 6.

Only a single packaging material roll 11, which has a width of approximately 500 mm, is required to package the entire circumference of roll 2. The packaging material can be a packing paper, which makes it possible to effect a cost-effective packaging. By coordinating the wrapping speed of roll 2, the forward axial feed of packaging material 12 and the angle between the roll axes, it is possible to produce a wrapping that is essentially free of lateral stress on the packaging material. Despite the helical wrapping of roll 2 with the packaging material 12, it is still possible to uniformly fold in the packaging material on the axial end of roll 2 as is the case when roll 2 is wrapped in a conventional, non-helical manner. Additionally, extra layers of packaging material can be used to improve the protection of the edges of the roll, while still utilizing a minimum amount of packaging material to wrap the majority of the roll 2 (i.e., the circumferential portion of the roll).

Having described the presently preferred exemplary embodiment method and apparatus for packaging a roll of material in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A method for packaging a roll of web material with a paper packaging material, comprising the steps of:

placing a first strip of the paper packaging material against the roll so that a longitudinal axis of the first strip of paper packaging material is disposed at an acute angle with respect to a circumferential direction of the roll of web material, said circumferential direction being a direction that is tangent to a circumferential surface of the roll and is parallel to an axial end of the roll;

helically wrapping the first strip of paper packaging material around the roll of web material so that at least one section of the circumferential surface of the roll of web material at an end of the roll remains uncovered;

placing a second strip of paper packaging material against the roll so that a longitudinal axis of the second strip is disposed parallel to the circumferential direction of the roll;

wrapping the second strip about the roll so that a portion of said second strip forms an axial projection adjacent to an axial end of the roll and a portion of said second strip covers the uncovered circumferential surface of the roll;

wherein a position of the paper packaging material is adjustable so adjacent wrapping layers of the packaging material overlap one another, the second strip of packaging material is applied after the first strip of packaging material, the packaging material is packing paper.

2. The method according to claim 1, wherein a position of the packaging material is adjustable so adjacent wrapping layers of the packaging material overlap one another.

3. The method according to claim 2, wherein the adjacent wrapping layers overlap one another by approximately half the width of the packaging material.

4. The method according to claim 1, wherein the helical packaging material is disposed between the axial ends of the roll.

5. The method according to claim 1, wherein both the first and second strips of packaging material originate from the same roll of packaging material.

6. The method according to claim 1, wherein the second strip of packaging material is wrapped around the roll with a greater number of layers than the first strip of packaging material.

7. The method according to claim 1, wherein adjacent packaging material layers are glued to one another.

8. The method according to claim 1, wherein the packaging material has a width of at least 350 mm.

9. An apparatus for packaging a roll of web material with a packaging material, comprising:

a wrapping station having a roller drive;

a packaging strip dispenser having a packaging strip delivery device, a position of said packaging strip delivery device being adjustable so that an acute angle is defined between a longitudinal axis of a packaging material being dispensed by said packaging strip delivery device and a circumferential direction of the roll of web material, said circumferential direction being a direction that is tangent to a circumferential surface of said roll and is parallel to an axial end of said roll, said packaging material being axially movable with respect to said roll of web material, and a control device being connected to a diameter measuring device for measuring the diameter of the roll of web material, said control device controlling and coordinating the wrapping speed of said roll of web material and the forward feed rate of said packaging material dispenser based on the diameter of the roll of web material;

wherein said packaging material is packing paper.

10. The apparatus according to claim 9, wherein said packaging material being dispensed from a packaging roll, which has an axis, said packaging roll being movable from a position in which its axis is parallel to the axis of the roll of web material into a position in which the axes define an acute angle therebetween.

11. The apparatus according to claim 9, wherein said packaging strip dispenser is rotatable with respect to said roll of web material.

12. The apparatus according to claim 9, wherein said packaging strip dispenser includes a driving gear to move said packaging strip dispenser axially with respect to said roll of web material.

13. The apparatus according to claim 9, wherein said packaging material dispenser includes an adhesive application device.

14. The apparatus according to claim 13, wherein said adhesive application device is a water application device.

15. The apparatus according to claim 14, wherein said adhesive application device is a heat application device.

* * * * *